US007118404B2

(12) United States Patent
Ploesser

(10) Patent No.: US 7,118,404 B2
(45) Date of Patent: Oct. 10, 2006

(54) INSULATION CUTTING AND DISPLACING CONTACT ELEMENT

(75) Inventor: Hartmuth Ploesser, Lautertal (DE)

(73) Assignee: Tyco Electronics AMP GmbH, Bensheim (DE)

( * ) Notice: Subject to any disclaimer, the term of this patent is extended or adjusted under 35 U.S.C. 154(b) by 0 days.

(21) Appl. No.: 11/111,701

(22) Filed: Apr. 21, 2005

(65) Prior Publication Data

US 2005/0272299 A1 Dec. 8, 2005

(30) Foreign Application Priority Data

Apr. 21, 2004 (DE) ..... 10 2004 019 360

(51) Int. Cl.
*H01R 12/00* (2006.01)

(52) U.S. Cl. ..... 439/398; 439/396; 439/395; 439/397

(58) Field of Classification Search ..... 439/395, 439/397, 398, 403
See application file for complete search history.

(56) References Cited

U.S. PATENT DOCUMENTS 4,039,239 A * 8/1977 Cobaugh et al. ..... 439/398
4,118,103 A * 10/1978 Leidy et al. ..... 439/398
4,130,331 A * 12/1978 Neff et al. ..... 439/396
4,210,379 A 7/1980 Vachhani et al. ..... 339/101
4,548,459 A * 10/1985 Mosser, III ..... 439/443
4,895,531 A * 1/1990 Vignoli ..... 439/398
4,952,169 A * 8/1990 Hayes, Sr. ..... 439/403
5,616,047 A * 4/1997 Lutsch ..... 439/397
5,915,988 A * 6/1999 Bitsch et al. ..... 439/398
6,682,362 B1 * 1/2004 Herrmann et al. ..... 439/395
6,866,536 B1 * 3/2005 Lee ..... 439/395

FOREIGN PATENT DOCUMENTS

EP 0 433 625 A1 6/1991

OTHER PUBLICATIONS

European Search Report for Application No. EP 05 00 8668 dated Jul. 28, 2005, mailed Aug. 3, 2005.

* cited by examiner

*Primary Examiner*—Tulsidas C. Patel
*Assistant Examiner*—Harshad Patel
(74) *Attorney, Agent, or Firm*—Barley Snyder LLC

(57) ABSTRACT

An insulation cutting and displacing contact element comprises a substantially U-shaped insulation displacement portion and a clamping portion. The insulation displacement portion has a base with a wire insertion opening. The base has first and second legs extending therefrom. Each of the first and second legs has an insulation displacement slot that communicates with the wire insertion opening. The first leg has a spring contact member projecting into an inner portion of the insulation displacement portion. The clamping portion extends from the second leg. The clamping portion is bent about a bending axis by about 90 degrees. The clamping portion has tongues for securing a connecting wire.

17 Claims, 2 Drawing Sheets

INSULATION CUTTING AND DISPLACING CONTACT ELEMENT

FIELD OF THE INVENTION

The invention relates to an insulation cutting and displacing contact element with an insulation displacement portion having a first leg with a spring contact member and a second leg with a clamping portion.

BACKGROUND OF THE INVENTION

An insulation cutting and displacing contact element (hereinafter referred to as "contact element") typically include a U-shaped insulation displacement portion and are used, for example, with windings. One end of an enamelled wire is positioned in a chamber of an insulated housing. The insulation cutting and displacing contact element is inserted into the chamber. A portion of the enamelled wire, which is positioned in the chamber, is received in a wire insertion opening and insulation displacement slots of the contact element. As the contact element is further inserted into the chamber, sharp cutting edges of the contact element displace the insulation on the enamelled wire and make electrical contact with a conductor of the enamelled wire. A contact pin or contact blade can then be inserted into the contact element. The contact pin or contact blade contacts a spring contact member that projects into an inner portion of the insulation displacement portion.

Normally, the contact element is punched and folded from a single sheet of spring steel. The spring contact member is formed by folding an extension of a first leg of the insulation displacement portion around a first bending axis by about 180 degrees. This folded portion is then folded in the same direction around a second bending axis by less than about 180 degrees. As a result, the spring contact member is positioned in the proximity of the first bending axis in contact with an opposing inner face of a second leg of the U-shaped insulation displacement portion or in the proximity thereof. The pin contact or blade contact can thereby be clamped between the spring contact member and the second leg of the U-shaped insulation displacement to ensure good electrical contact.

The configuration of the contact element previously discussed, however, does not allow the contact element to be connected to an additional module, such as, a resistor, a blocking diode, or the like. It is therefore desirable to develop a contact element wherein the contact element in terms of potential not only forms a unit with the inserted contact pin or contact blade but also with a connecting wire of a module.

SUMMARY OF THE INVENTION

It is therefore an object of the invention to provide an insulation cutting and displacing contact element wherein a simple additional connection to a connecting wire of a module is possible without considerable production effort.

This and other objects are achieved by an insulation cutting and displacing contact element comprising a substantially U-shaped insulation displacement portion and a clamping portion. The insulation displacement portion has a base with a wire insertion opening. The base has first and second legs extending therefrom. Each of the first and second legs has an insulation displacement slot that communicates with the wire insertion opening. The first leg has a spring contact member projecting into an inner portion of the insulation displacement portion. The clamping portion extends from the second leg. The clamping portion is bent about a bending axis by about 90 degrees. The clamping portion has tongues for securing a connecting wire.

This and other objects are further achieved by an insulation cutting and displacing contact element comprising a substantially U-shaped insulation displacement portion and a clamping portion. The insulation displacement portion has a base with a wire insertion opening. The base has first and second legs extending therefrom. Each of the first and second legs has an insulation displacement slot that communicates with the wire insertion opening. The first leg has a spring contact member projecting into an inner portion of the insulation displacement portion. The clamping portion extends from the second leg. The clamping portion has a longitudinal slot for receiving a connecting wire.

DETAILED DESCRIPTION OF THE INVENTION

Figure 1:
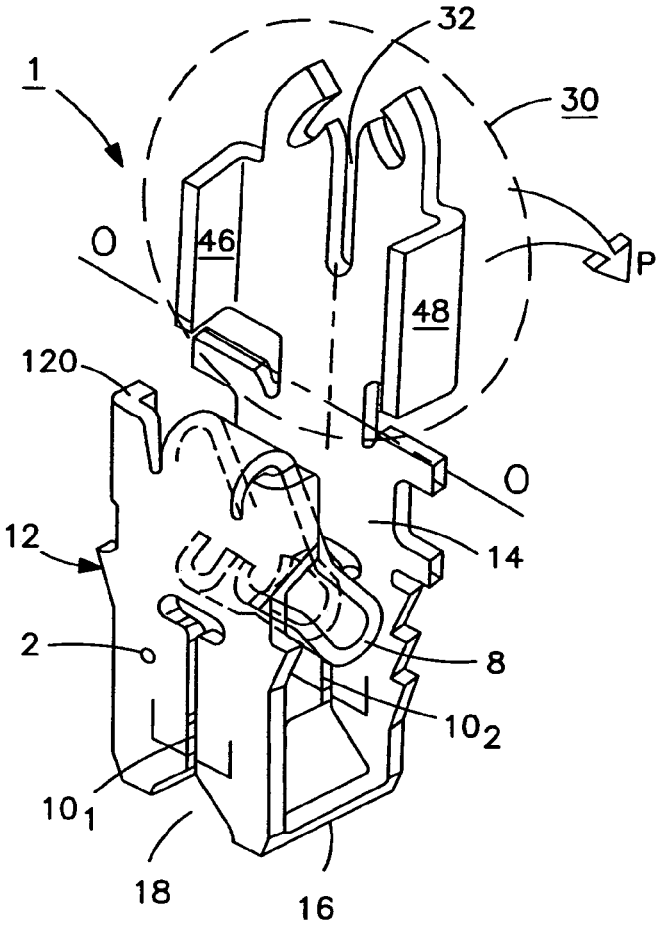
FIG. 1 is a perspective view of an insulation cutting and displacing contact element according to the invention.

FIG. 1 shows an insulation cutting and displacing contact element (hereinafter referred to as "contact element") 1. The contact element 1 includes an insulation displacement portion 2 and a clamping portion 30. The insulation displacement portion 2 is formed on a lower half of the contact element 1 and has a configuration known in the art. The clamping portion 30 extends from the insulation displacement portion 2 above a bending axis O—O. The contact element 1 may be punched and folded out of spring steel strip stock.

The insulation displacement portion 2 positioned below the bending axis O—O will now be explained in greater detail. As shown in FIG. 1, the insulation displacement portion 2 is substantially U-shaped in cross-section and includes a base 16 and first and second legs 12, 14, respectively. A wire insertion opening 18 is provided in the base 16 of the insulation displacement portion 2, and first and second insulation displacement slots 101, 102 are formed in the first and second legs 12, 14, respectively.

Figure 3:
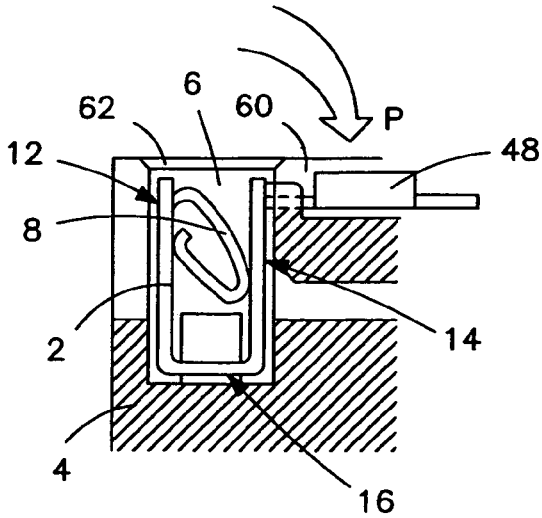
FIG. 3 is a sectional view through a chamber of an insulated housing in which the insulation cutting and displacing contact element is arranged.

The first leg 12 of the insulation displacement portion 2 has an end face 120 and a spring contact element 8 formed from an extension of the first leg 12. As shown in FIGS. 1 and 3, the spring contact element 8 is formed by folding a portion of the extension of the first leg 12 back on itself by about 180 degrees around a first bending axis that extends parallel to the bending axis O—O. Subsequently, the extension is folded around a second bending axis that is in a region of the end face 120 of the first leg 12 toward an inner portion of the insulation displacement portion 2 such that the spring contact element 8 projects into an inner portion of the insulation displacement portion 2 and either comes into contact with an inner face of the second leg 14 or is positioned only a slight distance from the inner face of the second leg 14.

Figure 2:
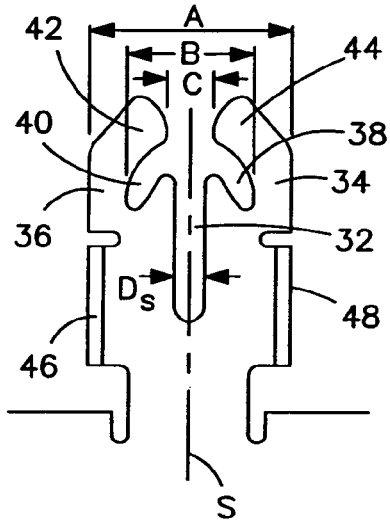
FIG. 2 is a plan view of a clamping portion of the insulation cutting and displacing contact element shown in FIG. 1.
Figure 4C:
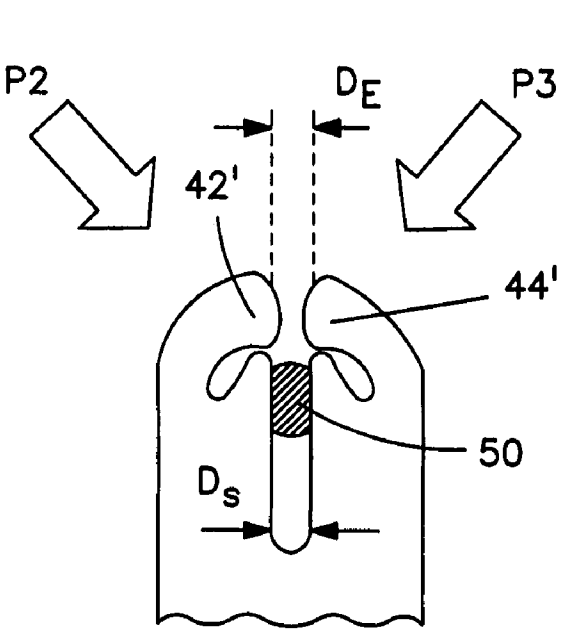
FIGS. 4(*a*) to 4(*c*) are schematic diagrams showing the steps for inserting a connecting wire into the clamping portion of the insulation cutting and displacing contact element.
Figure 4B:
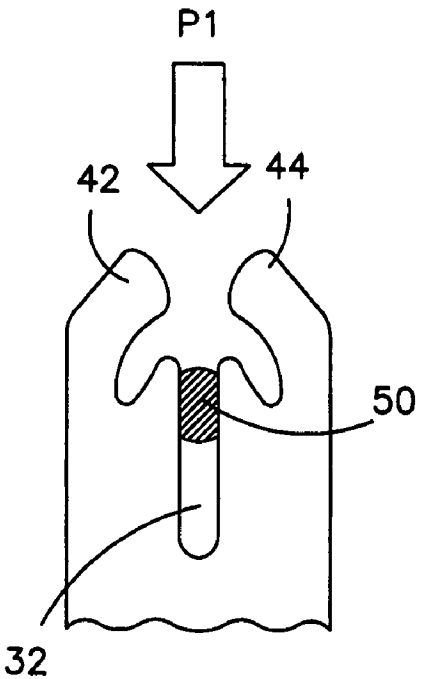
Figure 4A:
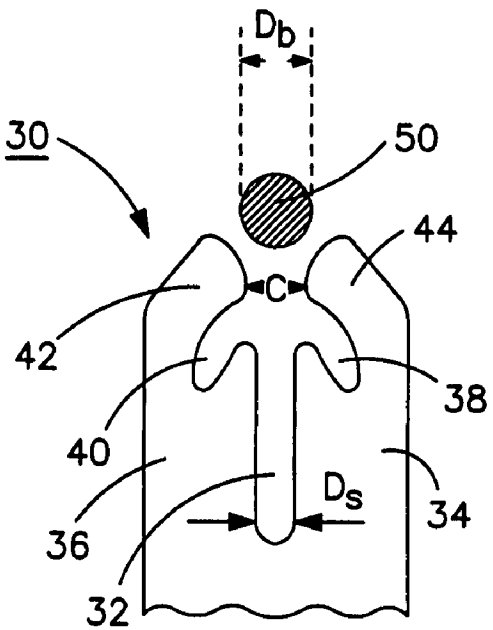

The clamping portion 30 extending from the second leg 14 above the bending axis O—O will now be explained in greater detail. As shown in FIG. 1, the clamping portion 30 and the second leg 14 are a single piece and lie in a single main plane. The clamping portion 30 has first and second stabilizing walls 46, 48, respectively. The first and second stabilizing walls 46, 48 extend from the main plane by about 90 degrees. In an alternate embodiment, the first and second stabilizing walls 46, 48 may be omitted. As shown in FIG. 2, the clamping portion 30 has a width A. The clamping portion 30 is configured symmetrically with respect to a symmetrical axis S. The symmetrical axis S forms a central axis of a longitudinal slot 32. The longitudinal slot 32 has a longitudinal slot width DS. The longitudinal slot 32 begins at a free end of the clamping portion 30 and extends until about a middle of the first and second stabilizing walls 46, 48. The longitudinal slot 32 divides the clamping portion 30 symmetrically into first and second blades 34, 36, respectively. The first and second blades 34, 36 each have a transverse slot 38, 40, respectively. The transverse slots 38, 40 are orientated laterally downwards from the longitudinal slot 32 and form tongues 44, 42, respectively, at the free end of the clamping portion 30. The transverse slots 38, 40 extend laterally into the first and second blades 34, 36 to a depth defined by a transverse slot width B. Mutually facing edges of the tongues 42, 44 form an insertion opening for a connecting wire 50, as shown in FIG. 4(*a*). As shown in FIG. 2, the insertion opening has an insertion opening width C.

The operation of the contact element 1 will now be described in greater detail. As shown in FIG. 3, the clamping portion 30 is folded about the bending axis O—O in a direction of arrow P to an angle of approximately 90 degrees with respect to the main plane of the second leg 14 of the insulation displacement portion 2. The insulation displacement portion 2 is inserted into a chamber 6 of an insulated housing 4 such that the first leg 12 of the insulation displacement portion 2 lies below a contact pin insertion opening 62 of the insulated housing 4. The tongues and/or barbs on the first and second legs 12, 14 engage with side walls of the chamber 6 to secure the contact element 1 therein. The clamping portion 30 is accommodated by a recess 60 in the insulated housing 4, which communicates laterally with the chamber 6. The first and second stabilizing walls 46 and 48 stabilize the position of the clamping portion 30. The clamping portion 30 may be folded about the bending axis O—O before or after insertion of the insulation displacement portion 2 of the contact element 1 into the chamber 6 of the insulated housing 4.

An insulated wire (not shown), for example, an enamelled wire, is fed through a bottom portion of the chamber 6 before the insulation displacement portion 2 is pressed from above into the chamber 6. As the insulation displacement portion 2 is pressed from above into the chamber 6, the insulated wire (not shown) is received in the wire insertion opening 18 in the base 16 of the insulation displacement portion 2 and the first and second insulation displacement slots 101, 102 in the first and second legs 12 14. Mutually facing edges of the first and second insulation displacement slots 101, 102 displace the insulation of the insulated wire (not shown) so that electrical contact is made between a conductor (not shown) of the insulated wire (not shown) and the contact element 1.

A mating plug (not shown) with at least one contact pin (not shown) or contact blade (not shown) is then mated with the contact element 1. The contact pin (not shown) or contact blade (not shown) passes through the contact pin insertion opening 62 and into the chamber 6. The contact pin (not shown) or contact blade (not shown) is then received between the spring contact element 8 and the second leg 14.

As shown in FIG. 4(*a*), in either the extended state of the clamping portion 30 shown in FIG. 1 or in the angled state of the clamping portion 30 shown in FIG. 3, the connecting wire 50 of a module (not shown), for example, of a diode, resistor, or the like, is positioned proximate the insertion opening and between the mutually facing edges of the tongues 42, 44 of the clamping portion 30. The connecting wire 50 has a diameter DD slightly larger than the insertion opening width C. The insertion opening width C is in turn slightly larger than the longitudinal slot width DS of the clamping portion 30.

As shown in FIG. 4(*b*), the connecting wire 50 is then pressed in a direction of arrow P1 into the longitudinal slot 32. As the connecting wire 50 passes through the insertion opening and between the tongues 42, 44, the tongues 42, 44 slightly dilate due to their elasticity. During receipt into the longitudinal slot 32, the connecting wire 50 becomes slightly deformed and assumes the width of the longitudinal slot 32 in a deformed region. In this state, as shown in FIG. 4(*b*), the connecting wire 50 is rigidly clamped by the first and second blades 34, 36 of the clamping portion 30 in the longitudinal slot 32.

To additionally secure the connecting wire 50 in the clamping portion 30, pressure is exerted on an outer surface of the tongues 42, 44 laterally from above in a direction of arrows P2 and P3, as shown in FIG. 4(*c*). Consequently, the tongues 42, 44 are displaced with respect to the first and second blades 34, 36 to the position indicated in FIG. 4(*c*) by the reference numerals 42' and 44'. This displacement constricts the space between the tongues 42' and 44' to a width DE. The width DE is significantly less than the longitudinal slot width DS. In an extreme case, the value of the width DE may be zero. The relationship between the insertion opening width C, the longitudinal width DS, and the width DE of the space between the tongues 42' and 44' is:

$$C \approx DS > DE \geqq 0$$

In the contact element 1 according to the invention, the contact element 1 may be accommodated in a single chamber 6 of the insulated housing 4 and may be punched and folded from a single piece of sheet metal made of, for example, an elastic wrought copper alloy.

In a simple configuration, the clamping portion 30 extends straight from the second leg 14 of the insulation displacement portion 2 and projects from the chamber 6 such that the entire contact element 1 is received in the insulated housing 4. Because the clamping portion 30 is formed symmetrically in relation to the symmetrical axis S through the second insulation displacement slot 102 of the second leg 14, the contact element 1 is easily connected and manipulated. The symmetrical design of the clamping portion 30 also enables the contact element 1 to be easily pressed into the chamber 6 of the insulated housing 4.

Because the wire insertion opening 18 of the insulation displacement portion 2 and the contact pin insertion opening 62 upstream thereof in the insulated housing 4 dictate the direction of insertion of the associated contact pins (not shown) or contact blades (not shown), a straight extension of the second leg 14 of the insulation displacement portion 2 would be an obstacle for the mating plug (not shown). For this reason, the clamping portion 30 is connected to the second leg 14 and can be folded into a position displaced by about 90 degrees with relation to the second leg 14.

The folding of the clamping portion 30 through about 90 degrees can take place before or after the connection of the connecting wire 50 to the clamping portion 30. The connection procedure should preferably take place in a state in which the clamping portion 30 is angled away by about 90 degrees. Because the connecting wire 50 is clamped rigidly in the longitudinal slot 32 and comes into contact with the mutually facing edges of the first and second blades 34, 36 formed by the longitudinal slot 31, it has the same potential as the insulation displacement portion 2 provided in the chamber 6 of the insulated housing 4.

Depending on the application, the contact element 1 may be exposed to vibrations and other mechanical loads, which may cause the connecting wire 50 clamped in the longitudinal slot 31 to come loose. In order to additionally secure the connecting wire 50 to the clamping portion 30, the first and second blades 34, 36 are provided with transverse slots 38, 40 that extend from the longitudinal slot 32. The transverse slots 38, 40 form tongues 42, 44 at the free ends of the first and second blades 34, 36. The tongues 42, 44 are foldable into the longitudinal slot 32 and into the transverse slots 38, 40 in order to partially or entirely close the longitudinal slot 32 at its open end. The closure of the longitudinal slot 32 at its open end will prevent the connecting wire 50 from coming loose and will prevent the connecting wire 50 from coming out of the longitudinal slot 32 even if the longitudinal slot 32 can no longer hold the connecting wire 50.

What is claimed is:

1. An insulation cutting and displacing contact element, comprising:

a substantially U-shaped insulation displacement portion having a base with a wire insertion opening, the base having first and second legs extending therefrom, each of the first and second legs having an insulation displacement slot that communicates with the wire insertion opening, the first leg having a spring contact member projecting into an inner portion of the insulation displacement portion; and a clamping portion extending from the second leg, the clamping portion having a longitudinal slot for receiving a connecting wire, the clamping portion including tongues that are foldable into the longitudinal slot.

2. The contact element of claim 1, wherein the clamping portion is positioned about 90 degrees from the second leg.

3. The contact element of claim 1, wherein the contact element is formed from a single piece of sheet metal.

4. The contact element of claim 1, wherein the clamping portion includes first and second stabilizing walls.

5. The contact element of claim 4, wherein the first and second stabilizing walls are positioned about 90 degrees from a main plane of the clamping portion.

6. The contact element of claim 1, wherein the clamping portion is formed symmetrically with relation to a symmetrical axis that extends through the longitudinal slot and the insulation displacement slot of the second leg.

7. The contact element of claim 1, wherein the clamping portion includes transverse slots that form the tongues.

8. The contact element of claim 1, wherein the tongues are spaced from each other and the longitudinal slot has a longitudinal slot width greater than a width of the space between the tongues after the tongues have been folded into the longitudinal slot.

9. The contact element of claim 1, wherein the contact element is entirely arranged within an insulated housing.

10. An insulation cutting and displacing contact element, comprising:

a substantially U-shaped insulation displacement portion having a base with a wire insertion opening, the base having first and second legs extending therefrom, each of the first and second legs having an insulation displacement slot that communicates with the wire insertion opening, the first leg having a spring contact member projecting into an inner portion of the insulation displacement portion; and a clamping portion extending from the second leg, the clamping portion being bent about a bending axis by about 90 degrees, the clamping portion having tongues for securing a connecting wire, the clamping portion having a longitudinal slot for receiving the connecting wire, the tongues being foldable into the longitudinal slot.

11. The contact element of claim 10, wherein the contact element is formed from a single piece of sheet metal.

12. The contact element of claim 11, wherein the clamping portion includes first and second stabilizing walls.

13. The contact element of claim 12, wherein the first and second stabilizing walls are positioned about 90 degrees from a main plane of the clamping portion.

14. The contact element of claim 10, wherein the clamping portion is formed symmetrically with relation to the longitudinal slot.

15. The contact element of claim 10, wherein the tongues are spaced from each other and the longitudinal slot has a longitudinal slot width greater than a width of the space between the tongues after the tongues have been folded into the longitudinal slot.

16. The contact element of claim 10, wherein the clamping portion includes transverse slots that extend from the longitudinal slot that form the tongues.

17. The contact element of claim 11, wherein the contact element is entirely arranged within an insulated housing.

* * * * *